United States Patent [19]

Giulini

[11] 4,150,515

[45] Apr. 24, 1979

[54] GUTTER STRUCTURE

[75] Inventor: Luciano Giulini, Milan, Italy

[73] Assignee: Cartec Costruzione Articoli Tecnici di Luciano Giulini, Milan, Italy

[21] Appl. No.: 787,217

[22] Filed: Apr. 13, 1977

[30] Foreign Application Priority Data

Apr. 13, 1976 [IT] Italy ..... 22256 A/76

[51] Int. Cl.[2] ..... E04D 13/00; E04D 13/08

[52] U.S. Cl. ..... 52/12; 52/16; 52/100

[58] Field of Search ..... 61/14, 15; 138/27, 28; 285/302, 177; 52/11, 12, 16, 100, 13, 573

[56] References Cited

U.S. PATENT DOCUMENTS

| | | | |
|---|---|---|---|
| 1,513,673 | 10/1924 | Pearson | 61/14 |
| 2,036,131 | 3/1936 | Gaertner et al. | 52/100 |
| 2,274,078 | 2/1942 | Marzolf | 52/16 |
| 2,461,610 | 2/1949 | Lord | 52/12 |
| 2,994,433 | 8/1961 | Sandin | 52/12 X |
| 3,213,627 | 10/1965 | Blayden | 138/27 X |
| 3,355,895 | 12/1967 | Bayes et al. | 52/11 X |
| 3,670,505 | 6/1972 | Weaver | 52/12 X |
| 3,703,194 | 11/1972 | Giordano | 52/16 X |
| 3,866,950 | 2/1975 | Skoch | 285/177 X |
| 3,913,284 | 10/1975 | Hall | 52/16 X |

FOREIGN PATENT DOCUMENTS

| | | | |
|---|---|---|---|
| 259215 | 1/1968 | Austria | 52/11 |
| 717700 | 9/1965 | Canada | 52/11 |
| 2005987 | 9/1971 | Fed. Rep. of Germany | 61/14 |
| 2035199 | 1/1972 | Fed. Rep. of Germany | 52/16 |
| 2155122 | 5/1973 | Fed. Rep. of Germany | 52/16 |
| 2162084 | 6/1973 | Fed. Rep. of Germany | 52/16 |
| 2201213 | 8/1973 | Fed. Rep. of Germany | 52/11 |
| 2244420 | 4/1974 | Fed. Rep. of Germany | 52/16 |
| 1966941 | 9/1975 | Fed. Rep. of Germany | 61/14 |
| 1418969 | 10/1965 | France | 52/11 |
| 1462416 | 11/1966 | France | 52/11 |
| 395495 | 12/1965 | Switzerland | 61/15 |

*Primary Examiner*—Leslie Braun

*Attorney, Agent, or Firm*—Browdy and Neimark

[57] ABSTRACT

Gutter lengths having a semicircular cross-section and upwardly extending sides, with curled or similarly bent upper edges, and coupling elements having portions adapted for tightly engaging the ends of the gutter lengths, are assembled together to form a gutter structure. At least one of the coupling elements, designed to compensate for the thermal changes in the gutter length, is fitted with a downspout.

7 Claims, 13 Drawing Figures

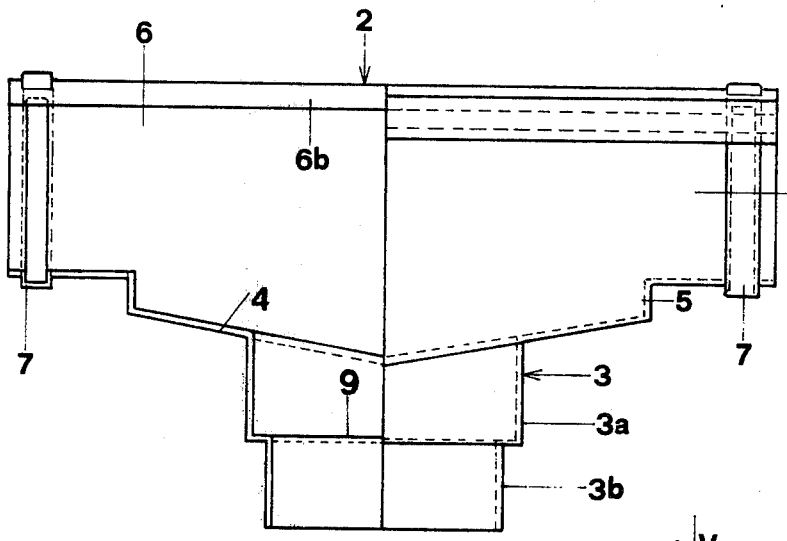
FIG 3
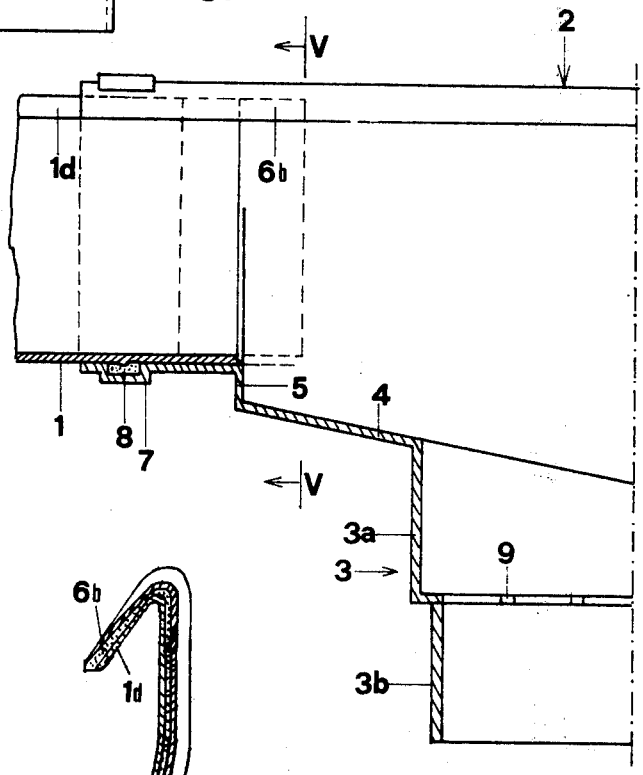
FIG 4
FIG 5
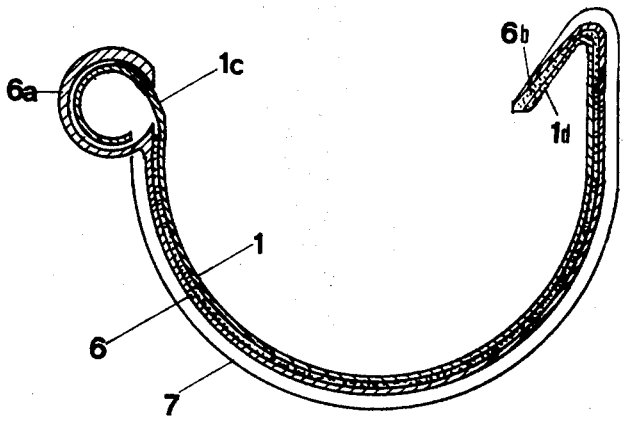

GUTTER STRUCTURE

BACKGROUND OF THE INVENTION

The present invention relates to a gutter structure of the type comprising a plurality of gutter lengths having a semicircular cross section and upwardly extended sides, with curled or similarly bent upper edges, and coupling elements designed to compensate for thermal changes in the gutter length, having portions adapted for joining the ends of the gutter lengths, at least one of the coupling elements to being fitted with a downspout.

According to conventional procedures, the different components of a gutter structure are connected to one another with a resilient packing interposed therebetween. Such packings, apart from ensuring a tight seal, also allow for a relative longitudinal sliding of single gutter lengths, whereby to compensate the thermal expansion caused by the changes in the outdoor temperature.

Usually, a change in the length of about 60 mm. for each standard gutter section (about 4 m.) is to be taken into account. Sometimes, a few gutter lengths are joined by gluing, without sealing packings, but in such cases difficulties are encountered, because of the remarkable increase in the total longitudinal expansion of gutter lengths glued to one another. In fact, the heretofore utilized coupling elements are not able to compensate changes in the length of gutters greater than about 30 mm, whereby the gluing of gutter lengths results in a greatly increased danger of deformations and breakages.

Moreover, the presently utilized gutter lengths are not very well suited to be glued to one another, since the intervening spaces where the glue is to be smeared, in place of the packings, have a not negligible width, and thus thick layers of glue, not capable of withstanding the changes in the environment, would be required.

SUMMARY OF THE INVENTION

The object of the present invention is to allow for a connection of gutter structure components either by gluing or by the interposition of a resilient packing, excluding in the former case any danger of deformations and breakages owing to thermal expansion.

Briefly, in the gutter structure according to the invention, the above problem is solved by having the ends of the gutter lengths tightly inserted into coupling elements and in close contact with the inner walls thereof, whereby a sealing can be obtained either by gluing, or by the interposition of a resilient packing. The coupling and compensating elements are formed with extensions of their ends, wherein the ends of adjacent gutter lengths can be slidingly engaged, while maintaining a tight seal. The length of the extensions allows for a compensation of the total thermal expansion of a plurality of gutter lengths connected by gluing to one another.

The advantages obtained by the invention consist in particular in that the various connections can be made in the conventional ways, i.e. either by the interposition of resilient packings, by which a relative sliding of single components is allowed for the compensation of thermal expansions, or by gluing, except for the coupling and compensating element, which is designed to compensate for all thermal expansions of glued gutter lengths.

Various general and specific objects, as well as further advantages of the invention will become apparent when reference is made to the following detailed description of the invention, considered in conjunction with the related drawings.

BRIEF DESCRIPTION OF THE DRAWINGS

FIG. 3 is a part sectional side view of the same coupling and compensating element, fitted with a downspout.

FIG. 4 is a partial sectional elevation of the same coupling and compensating element, having a gutter length connected thereto.

FIG. 5 is a cross-sectional view taken on the line V—V of FIG. 4.

DETAILED DESCRIPTION OF PREFERRED EMBODIMENT

Figure 2:
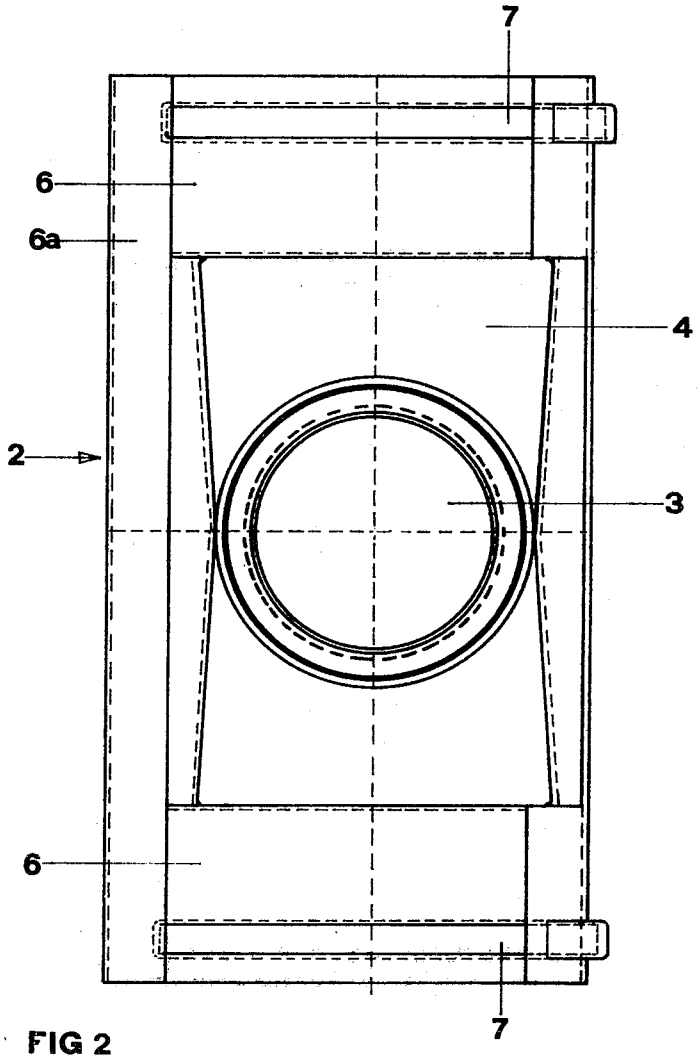
FIGS. 1 and 2 are a side view and a plan view, respectively, of a coupling element, fitted with a downspout.
Figure 1:
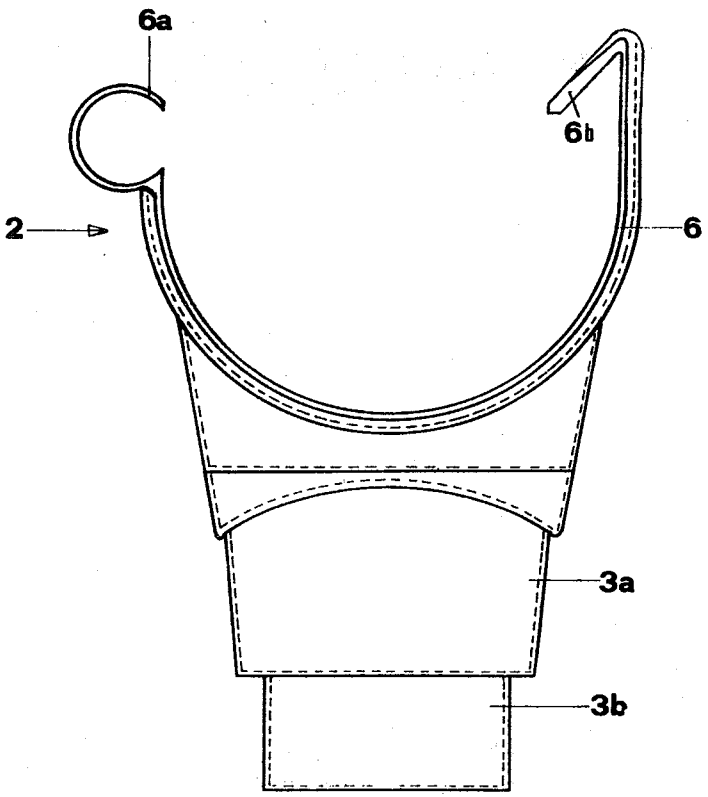
Figure 6:
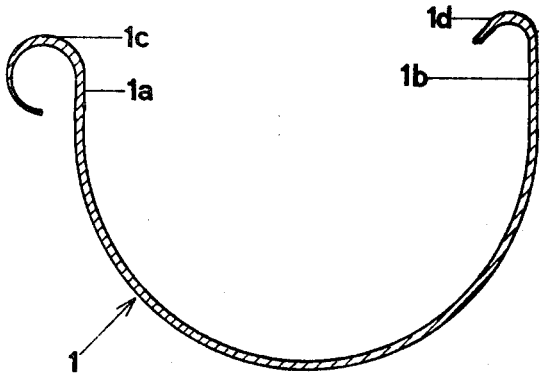
FIG. 6 is a cross-sectional view of a gutter length.
Figure 7:
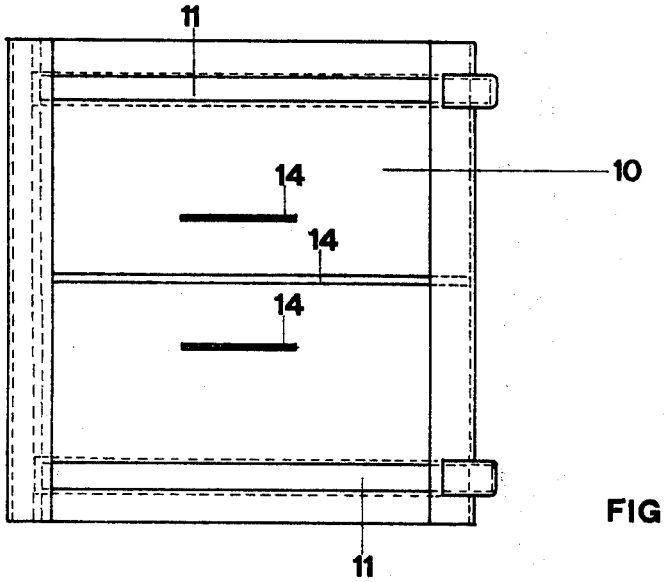
FIGS. 7, 8 and 9 respectively are a plan view, a cross-sectional view and a longitudinal sectional view of a plain coupling element.
Figure 8:
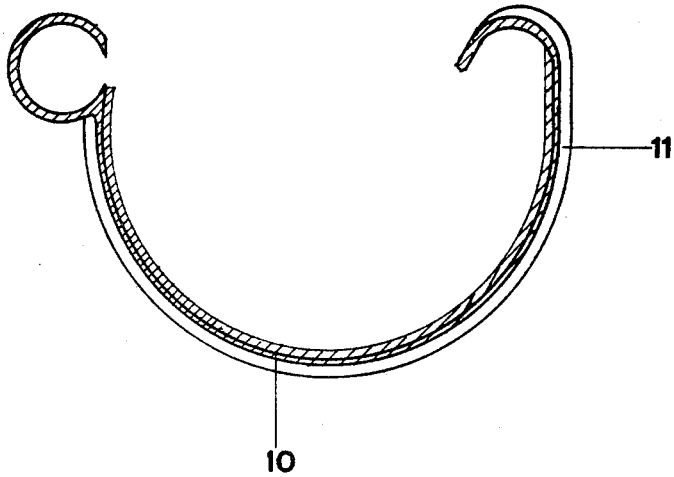
Figure 9:
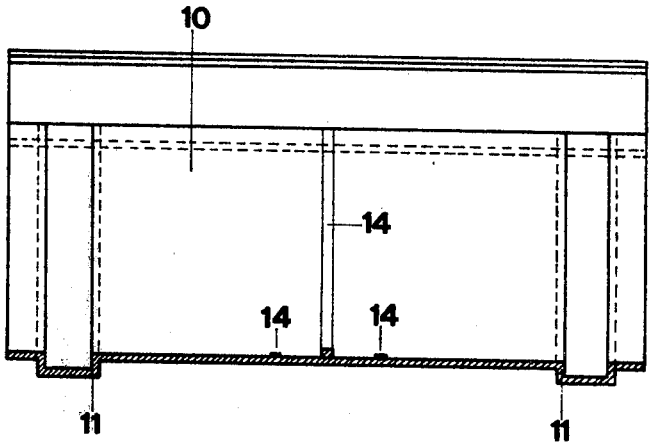

Referring now in greater detail to the drawings, the gutter structure according to the invention comprises gutter lengths 1, having a semicircular cross-section (see FIG. 6), with vertical extensions 1*a* and 1*b* of the sides, which end in a curl 1*c* and by a bend 1*d*, respectively, where the bend 1*d* is formed with a very small bending radius.

The curled end 1*c* is designed to be directed outwardly, while the bent end 1*d* is designed to be directed inwardly.

The gutter lengths are connected to one another by plain coupling elements (see FIGS. 7, 8, 9 and 10) or by downspouted coupling elements (see FIGS. 1, 2, 3 and 4), or even by angular coupling elements (not shown).

As described in more detail later on, the connection either by the plain coupling elements and by the downspouted coupling elements may be alternatively made by gluing, or by the interposition of resilient packings. In the latter case, a relative sliding motion of coupling elements and of gutter lengths is allowed for the compensation of thermal expansions, while in the case of glued joints, the total changes in the length are to be taken-up by the downspouted coupling elements, which should be suitably designed as shown in the FIGS. 1 to 5 inclusive.

Referring now to FIGS. 1 to 5, a coupling element with a downspout consists of a channel length 2, fitted at its center with a tubular shaped downspout fitting, that consists of two sections 3*a* and 3*b* having different diameters, and adapted to be connected with discharge pipes having the related different diameters.

The bottom of channel length 2 is formed with a recess 4 which, starting from the downspouting mouth, extends toward the end, as far as the steps 5, wherefrom further end extensions 6 extend, having a length such as to allow for the longitudinal thermal expansion of a number of gutter lengths that are joined by gluing with one another. Formed in each end extension 6 is a crosswise directed groove 7, into which a resilient sealing packing 8 can be accommodated.

The cross-sectional shape of extensions 6 is such as to allow for the accommodation of an end portion of a gutter length (see FIG. 1), showing also a curl 6*a* and a bent end 6*b*, with which the curl 1*c* and the bent edge 1*c* of the gutter can be respectively engaged. The walls of middle portion of channel 2 are shaped similarly to extensions 6, while the bottom is suitably merged into the recess 4. Fitted between the components 3*a* and 3*b* of fitting 3 is a grating 9, by which foreign matter, possibly conveyed by the water flowing from the gutter, are retained.

As shown in the FIG. 4, a short section of gutter length 1 is inserted into the extensions 6 of the coupling element, in close contact with the packings 8, that are fitted into the grooves 7. A seal is thus obtained, while a sliding motion of gutter ends in the coupling element is allowed. Owing to the extensions 6 and to particular shape of the coupling and downspouted element, a very large range of expansion of the ends is possible, as shown in dash lines in the FIG. 4. Otherwise stated, the fitting 3 can be attained by the ends of gutters 1 in the condition of maximum thermal expansion thereof.

Conversely, in the condition of maximum longitudinal contraction, the ends of gutter lengths 1 shall always remain in engagement with the packings 8. A plain coupling element, i.e. without compensating action, is shaped as shown in the FIGS. 7, 8 and 9. It merely consists of a channel length, having a cross-section wherein the gutter ends can be accommodated, similarly to the extensions 6. A close contact between the wall of element 10 and the walls of adjacent gutters is to be ensured, with an arrangement of overlapping portions similar to that shown in the FIG. 5, i.e. with a very narrow intervening space.

Formed close to the ends of element 10, are crosswise directed grooves 11, wherein resilient packings 12 can be fitted. As shown in the FIG. 10, instead of having recourse to a packing 12, a sealed connection can be obtained even by filling the intervening space between the element 10 and the ends of gutter 1 with a glue. Since the intervening space is very narrow, a thin layer of glue is sufficient, whereby a good resistance against the outdoor conditions is obtained.

Moreover, formed in the middle section of element 10 are noses 14, against which the ends of gutter 1 abut, when a sliding connection is provided.

Figure 11:
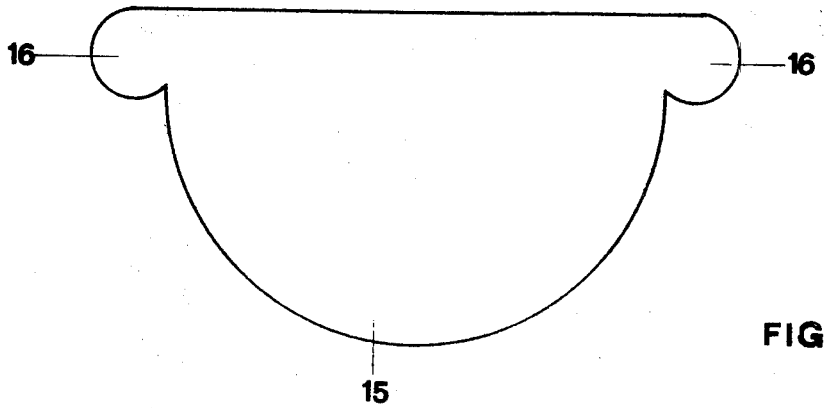
FIGS. 11 and 12 respectively show a closing head of a gutter structure, as viewed from either.
Figure 12:
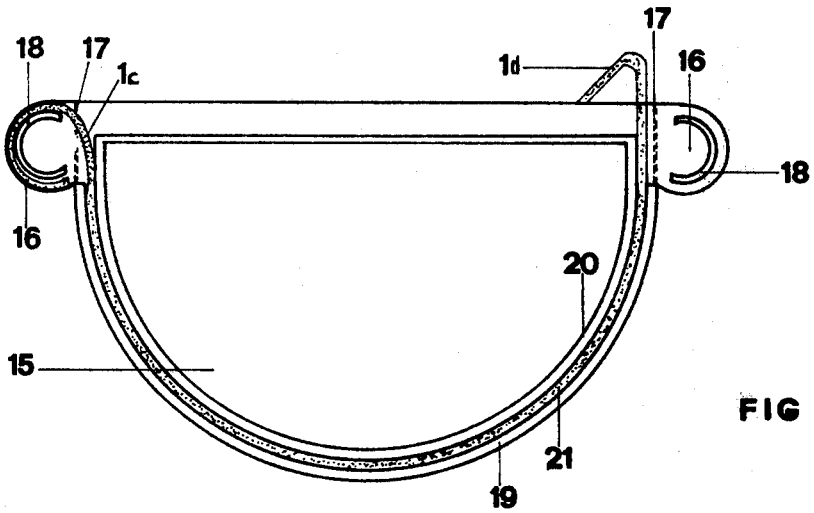
Figure 13:
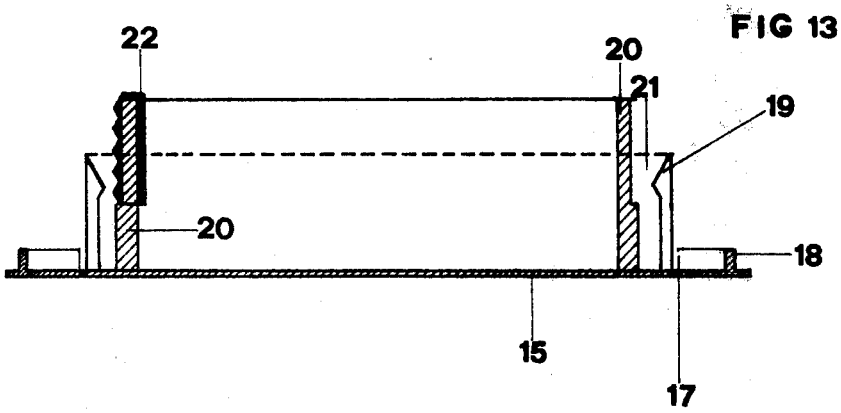
FIG. 13 is a cross-sectional view taken on the line XIII—XIII of FIG. 12.

Shown in the FIGS. 11, 12 and 13 is a head element for the closing of the ends of gutters 1. Such head element consists of a substantially semicircular shaped plate 15, having lugs 16 for the engagement with the curled edges 1*c* of gutters 1. The head element is symmetrically shaped in respect of a vertical axis, whereby it can be fitted both on the right end, and on the left end of a gutter 1. For such a purpose, since the cross-section of a gutter 1 is not symmetrical with respect to a vertical axis, the lugs 16 can be broken along weakening lines 17, whereby either of them can be removed, according to requirements.

Formed on one side of plate 15 are: two partly cylindrical shaped projections 18, located near the lugs 16, for the engagement with the curled edge 1*c* of gutters 1, and two substantially semicircular projections 19, 20 closely spaced near the edge, whereby to define an intervening space into which the end portion of gutters 1 can be inserted.

The projection 20 juts out more than the projection 19, and a resilient packing 22, having a U-shaped cross-section can be fitted thereon (see FIG. 13). The head plate 15 could be fitted in place by merely inserting it, and in such a case, the seal is ensured by the packing 22; however, it may be also glued, by having the intervening space 21 filled with a glue.

Shown in the FIG. 12 is the position of upper edges 1*c* and 1*d* (denoted by dash lines) of the sides of a gutter 1, in respect of the closing head. In the case as shown in the FIG. 12, the right lug 16 is removed, while when the positions of the upper edges 1*c* and 1*d* are reversed, the left lug 16 is removed.

After the above description, the assembly and operation of the gutter structure according to the invention are apparent.

Figure 10:
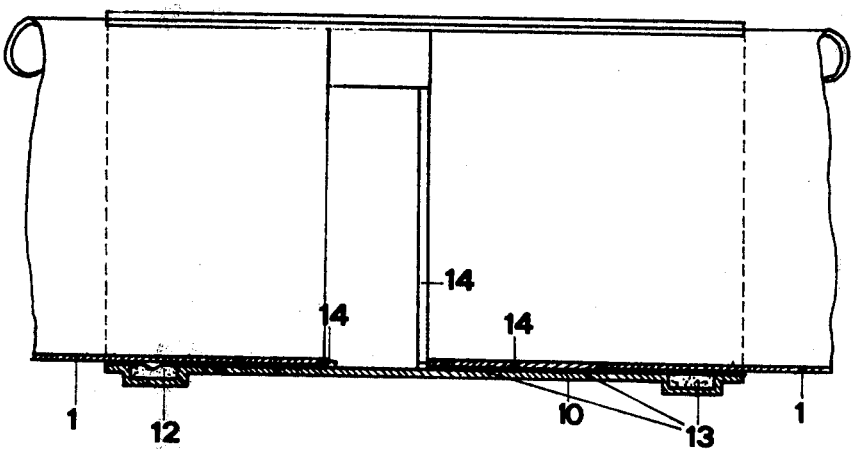
FIG. 10 is a longitudinal sectional view of the same coupling element, having the ends of two gutter lengths connected thereto.

The seal between the gutter lengths 1 and the plain coupling elements (FIGS. 7, 8, 9 and 10) can be obtained at will either by gluing, as shown in the right side of FIG. 10, or by interposition of resilient packings 12, as shown in the left side of same FIG. 10. In the latter case, the compensation for thermal expansion occurs in each coupling element 10, whereas when a gluing is performed, the total thermal expansion, i.e. the sum of longitudinal expansions of single gutter lengths 1, connected by gluing to one another, will be taken-up by the downspouted coupling element (see FIGS. 1, 2, 3 and 4).

As already stated, the downspouted coupling element allows for an even very wide range of expansion of the ends of gutter lengths 1 that are connected therewith, primarily because of extensions 6, wherein the sealing packings 8 are fitted.

The presence of recess 4 results in a downfall of the horizontal water stream directed toward the downspout, thereby ensuring a quick outflow even in the case of heavy rains (the water stream is caused to suddenly fall down along the steps 5).

As can be readily appreciated, the position of maximum penetration of gutter lengths ends (as shown by dash lines in the FIG. 4), which corresponds to maximum longitudinal expansion, occurs in the summer, i.e. when the falls of rain are reduced, whereby no outflow problems exist, even when the recess 4 is partly covered by the ends of gutters 1.

The shape of gutters 1 is particularly suited for ensuring high outflow capacities, while the bent edge 1*d*, having a small bending radius, allows for an easy inflow of rain water, even close to the gutter inner walls.

Moreover, the gutters 1 are closed by the end heads up to the top of the curled edges (see FIGS. 11, 12 and 13), whereby the whole cross-section of the gutters can be utilized.

Additionally, a single type of head can be utilized for closing both the right, and the left end of the gutter structure.

Both inner and outer angular coupling downspouted elements, having a design similar to above described straight coupling downspouted elements (see FIGS. 1, 2 and 3) can be moreover provided.

As can be readily appreciated, the gutter structure according to the invention lends itself to a double utilization, i.e. for the sealing of single gutter lengths either by gluing, or by the interpositions of packings.

Although only one preferred embodiment and selected modifications of the invention have been disclosed and described, it is apparent that other embodiments and modifications of the invention are possible within the scope of the appended claims.

The embodiment of the invention in which an exclusive property and privilege is claimed, is defined as follows:

1. A gutter structure, comprising:

a plurality of gutter lengths having upwardly extended sides with curled or similarly bent top edges; and a plurality of coupling elements into which the ends of said gutter lengths are inserted, in close contact with the inner walls thereof, at least one of said coupling elements being of the downspouting type;

wherein said coupling elements of the downspouting type include end extensions having a shape complementary to that of said gutter lengths, into which the ends of adjacent ones of said gutter lengths are slidingly fitted, the length of said extensions being such as to be able to take up the total longitudinal thermal expansions of a plurality of said gutter lengths that are fixedly connected to one another, each of said end extensions having transversely directed grooves packed with sealing packing;

a downspouting fitting; and a recessed floor between said end extensions and on either side of said downspout fitting, said recessed floor comprising a substantially rectangular portion stepped below the level of each said end extension and extending longitudinally from said downspout fitting to each said end extension, each said longitudinally recessed portion being inclined downwardly from said step to said downspout fitting, wherein the length of each said longitudinally recessed portion in said longitudinal direction is substantially greater than that of said downspout fitting and the width of each said longitudinally recessed portion in the transverse direction is substantially the same as that of said downspout fitting, such that the ones of said gutter lengths fitting into said respective end extensions will overhang said recessed portions at maximum extension without overhanging said downspout fitting, whereby the sliding of the ends of said gutter lengths is facilitated and a downflow of water directed toward said downspout fitting is caused without occluding said fitting.

2. A gutter structure according to claim 1, wherein said downspout fitting consists of two superposed sections having different diameters, for connection to discharge pipes having different diameters.

3. A gutter structure according to claim 1, wherein said downspout fitting includes a grating means for retaining possible foreign bodies.

4. A gutter structure according to claim 1, further including at least one end head fitted into an end of one of said gutter lengths, said end head comprising:

a plate having at least one top lug, said lug having a projection engaging the curled edges of said gutter length, said plate also having two concentric curved projections, by which an intervening space is defined, said projections being shaped such that the end of one of said gutter lengths is tightly fit into said intervening space.

5. Structure for assembly into a gutter, comprising:

a plurality of gutter lengths having upwardly extended sides with curled or similarly bent top edges;

a plurality of coupling elements into which the ends of said gutter lengths may be inserted, said coupling elements being shaped to receive the ends of said gutter lengths in close contact with the inner walls of said coupling elements, at least one of said coupling elements being of the downspouting type; and at least one end head comprising a plate having two top lugs symmetrically located with respect to the vertical axis thereof, said lugs having projections adapted to engage with the curled edges of said gutter lengths or end extensions, said plate further including weakening means for facilitating breaking off of said lugs to have said end head adapted to either end of the gutter structure, and said plate also having two concentric curved projections, by which an intervening space is defined, said projections being shaped such that the end of one of said gutter lengths can be tightly fitted into said intervening space;

wherein said coupling elements of the downspouting type include end extensions having a shape complementary to that of said gutter lengths, into which the ends of adjacent gutter lengths may be slidingly fitted, the length of said extensions being such as to be able to take up the total longitudinal thermal expansions of a plurality of said gutter lengths when fixedly connected to one another, each of said end extensions having transversely directed grooves for receiving sealing packing;

a downspout fitting; and a recessed floor between said end extensions and on either side of said downspout fitting, said recessed floor comprising a substantially rectangular portion stepped below the level of each said end extension and extending longitudinally from said downspout fitting to each said end extension, each said longitudinally recessed portion being inclined downwardly from said step to said downspout fitting, wherein the length of each said longitudinally recessed portion in said longitudinal direction is substantially greater than that of said downspout fitting and the width of each said longitudinally recessed portion in the transverse direction is substantially the same as that of said downspout fitting, such that the ones of said gutter lengths fitting into said respective end extensions will overhang said recessed portions at maximum extension without overhanging said downspout fitting;

whereby the sliding of the ends of said gutter lengths is facilitated and a downflow of water directed toward said downspout fitting is caused without occluding said fitting.

6. A structure according to claim 5, wherein said downspout fitting consists of two superposed sections having different diameters for connection to discharge pipes having different diameters.

7. A structure according to claim 5, wherein said downspout fitting includes a grating means for retaining possible foreign bodies.

* * * * *